US009493917B2

(12) United States Patent
Lesche

(10) Patent No.: US 9,493,917 B2
(45) Date of Patent: Nov. 15, 2016

(54) SLIDE HAMMER TAMPER WITH INTERCHANGEABLE TAMPER HEAD

(71) Applicant: Peter W Lesche, Millville, NJ (US)

(72) Inventor: Peter W Lesche, Millville, NJ (US)

( * ) Notice: Subject to any disclaimer, the term of this patent is extended or adjusted under 35 U.S.C. 154(b) by 58 days.

(21) Appl. No.: 14/532,322

(22) Filed: Nov. 4, 2014

(65) Prior Publication Data

US 2016/0122951 A1 May 5, 2016

(51) Int. Cl.
*E01C 19/32* (2006.01)
*E02D 3/046* (2006.01)

(52) U.S. Cl.
CPC ..... *E01C 19/32* (2013.01); *E02D 3/046* (2013.01)

(58) Field of Classification Search
CPC ..... E01C 19/32; E01C 19/288; E01C 19/35; E01C 19/22; E01C 19/4833; E02D 3/046; E02D 3/00; E02D 3/02; E02D 3/123
USPC ..... 405/271; 404/133.1
See application file for complete search history.

(56) References Cited

U.S. PATENT DOCUMENTS 868,238 A * 10/1907 Wheeler ..... B28B 1/04 404/133.1
983,613 A * 2/1911 Fahy ..... A01B 1/08 172/371
1,144,838 A * 6/1915 Griese ..... E02D 3/068 404/133.1
2,625,100 A * 1/1953 Williams ..... B41J 9/42 101/93.02
2,870,696 A * 1/1959 Yoch ..... E01C 19/32 404/133.1
2,884,842 A * 5/1959 Schmitz ..... E01C 19/35 173/131
3,117,378 A * 1/1964 Bowen ..... G01C 15/06 173/90
3,308,730 A * 3/1967 Vorwald ..... E01C 23/124 404/133.2

(Continued)

*Primary Examiner* — Abigail A Risic
(74) *Attorney, Agent, or Firm* — Stuart M. Goldstein

(57) ABSTRACT

A slide hammer tamper has a slide hammer positioned within a tamper sleeve. The slide hammer is a solid metal component or has a cavity containing a plurality of metal shot. A connector secures the slide hammer to the tamper sleeve, while allowing vertical, slideable motion between the slide hammer and tamper sleeve. The connector also limits the vertical movement of the slide hammer in relation to the tamper sleeve. Rotation between the slide hammer and tamper sleeve is restricted by a tamper bushing/connector configuration within the tamper sleeve. The tamper is adapted for use with different tamper heads, interchangeably connected to the tool. An adjustable handle secured around the tamper sleeve allows the position of the handle to be varied along the tamper sleeve. The tamper tip can be replaced with a new, unworn tip, when necessary.

17 Claims, 12 Drawing Sheets

(56) References Cited

U.S. PATENT DOCUMENTS 3,388,753 A * 6/1968 Bardwell ..... E21B 4/08 173/210
3,543,655 A * 12/1970 Uebel ..... E02D 3/068 404/133.1
4,082,471 A * 4/1978 Hiszpanski ..... E02D 3/068 173/207
4,241,795 A * 12/1980 Landry, Jr. ..... E21B 11/005 173/132
5,085,281 A * 2/1992 Selly ..... E04H 12/2215 173/128
5,370,192 A * 12/1994 Evinger ..... B25D 3/00 173/132
5,495,878 A * 3/1996 McKenen, Jr. ..... B27L 7/005 144/193.1
5,875,951 A * 3/1999 Ingle ..... B25C 1/02 173/90
5,878,822 A * 3/1999 Roy
5,934,139 A * 8/1999 Tucker ..... B21D 1/06 173/90
6,109,365 A * 8/2000 Lamoureux ..... A01B 1/02 173/128
6,125,719 A * 10/2000 Lowther ..... B25D 1/16 173/90
6,349,776 B1 * 2/2002 Hus ..... A01B 1/14 172/22
7,191,685 B2 * 3/2007 Lowther ..... B21D 1/06 81/27
7,682,102 B1 * 3/2010 Burke ..... E01C 19/35 404/133.05
8,291,995 B1 * 10/2012 Stoklasa ..... A01B 1/16 172/371
9,206,577 B2 * 12/2015 Lusk ..... E02D 7/04
2005/0252345 A1 * 11/2005 Carmien ..... B25D 1/045 81/22
2006/0165488 A1 * 7/2006 Morris ..... E02D 3/046 404/133.1

* cited by examiner

SLIDE HAMMER TAMPER WITH INTERCHANGEABLE TAMPER HEAD

BACKGROUND OF THE INVENTION

Hand held tamper tools have long been used to compact and tamp down stone, asphalt, concrete pavers, soil, and other types of ground surfaces. Many common manually operated tampers, however, do not have the requisite heft to efficiently and effectively accomplish many types of tamping operations. Other tampers are not easily portable or are cumbersome to use. Motorized or hydraulically operated tampers are available, but these have many operating parts which are subject to breakage. In addition, given the number of parts, such tools are unduly heavy. They are also expensive to purchase and maintain.

SUMMARY OF THE INVENTION

It is thus the object of the present invention to provide a slide hammer tamper which overcomes the limitations and disadvantages of prior tamper tools.

It is the object of the present invention to provide a slide hammer tamper which is efficient and effective in the manual tamping operation.

It is another object of the present invention to provide a slide hammer tamper which has a unique system for interchanging different tamper heads.

It is still another object of the present invention to provide a slide hammer tamper which is easily portable during the tamping operation.

It is a further object of the present invention to provide a slide hammer tamper which comprises a tamper tip which can be removed and replaced with another tamper tip when necessary.

It is another object of the present invention to provide a slide hammer tamper which has few components subject to breakage.

These and other objects are accomplished by the present invention, a slide hammer tamper having a slide hammer positioned within a tubular tamper sleeve. The slide hammer is solid metal or it has a cavity containing a plurality of metal shot. A connector secures the slide hammer to the tamper sleeve, while still allowing vertical, slideable motion between the slide hammer and tamper sleeve. The connector also limits the vertical movement of the slide hammer in relation to the tamper sleeve. Lateral rotation between the slide hammer and tamper sleeve is restricted by a tamper bushing/connector configuration within the tamper sleeve. The tamper is adapted for use with a variety of tamper heads, which are interchangeably connected to the tool. An adjustable handle secured around the tamper sleeve allows the worker to vary the position of the handle along the tamper sleeve. The tamper tip is designed so that it can be removed and replaced with a new, unworn tip, when necessary.

Novel features which are considered as characteristic of the invention are set forth in particular in the appended claims. The invention, itself, however, both as to its design, construction and use together with additional features and advantages thereof, are best understood upon review of the following detailed description with reference to the accompanying drawings.

DETAILED DESCRIPTION OF THE INVENTION

Figure 1:
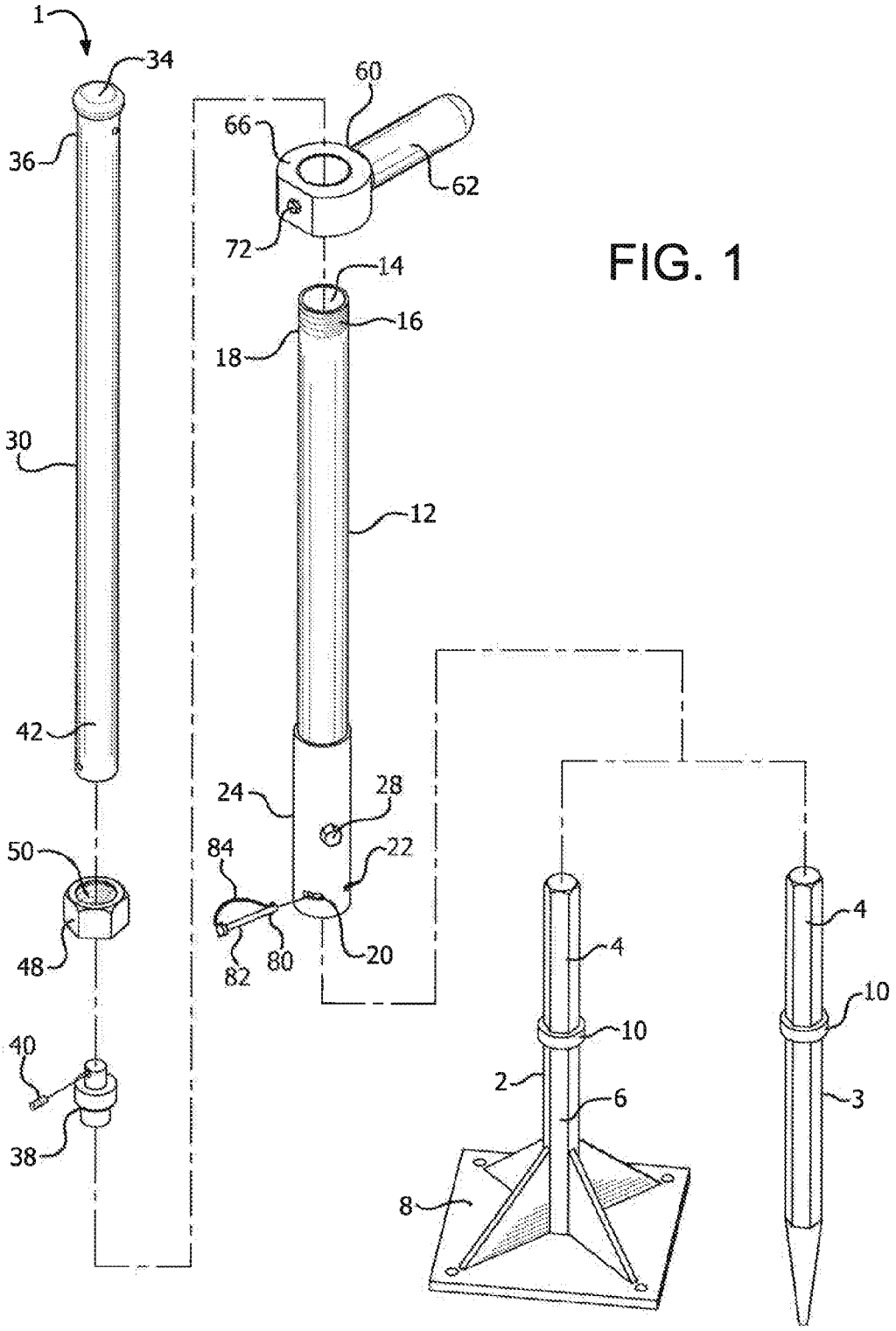
FIG. 1 is an exploded view of the components of the slide hammer tamper of the present invention.

Slide hammer tamper 1 comprises tamper head 2 having upwardly extending upper shaft 4, lower shaft 6, and tamper foot base 8. Tamper sleeve support 10 circumscribes and extends outwardly from shaft 4, which is hexagonal in configuration. Tamper head 2 is shown herein as not only having tamper foot base 8, but it is also contemplated that any tamper head, e.g. staked head 3, can be interchangeably utilized with the present invention. The means of connection, described hereinafter, between tamper head 2 and other available tamper heads, and the slide hammer tamper 1 itself allows the interchangeable use of different tamper heads.

Tamper sleeve 12, a cylindrical tube made of high strength metal or equivalent material, comprises through channel 14 extending the length of the tamper sleeve, threads or equivalent connection means 16 at upper end 18, and openings 20 and 22 at lower end 24. Also located at lower end 24 is internal sleeve bushing 26, connected within channel 14 of tamper sleeve 12 by bolt connector 28, which extends slightly into the channel.

Slide hammer 30 is an elongated element, also cylindrical in nature, made of high strength metal or equivalent material. Slide hammer 30 comprises handhold 34 located at upper end 36 and tamper tip 38 secured by pin or equivalent connector element 40 at lower end 42. Tamper tip 38 comprises connecting section 39, shoulder section 41, and tamping section 43. Connector element 40 is inserted into threaded opening 45 in connecting section 39 and then threadably engaged within threaded opening 47 at lower end 42 of slide hammer 30. An alternate connector element can comprise a press fit dowel pin, roll pin, or rivet which would be inserted into unthreaded openings in connecting section 39 of tamper tip 38 and in lower end 42 of slide hammer 30.

Connector 48 with internal threads 50 or equivalent connection means circumscribes slide hammer 30 and is configured to be slid along the exterior of the slide hammer. It is contemplated that in lieu of connecting nut 48, a suitable, equivalent retaining member could be held in place by threads 50 and 16 or be permanently welded in place without the need for threads or wrenching flats on the outside of 48.

Figure 10:
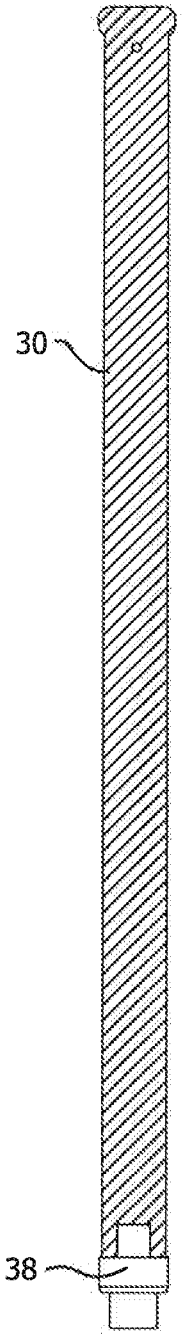
FIG. 10 is a cross-sectional view of one embodiment of the slide hammer of the slide hammer tamper.
Figure 11:
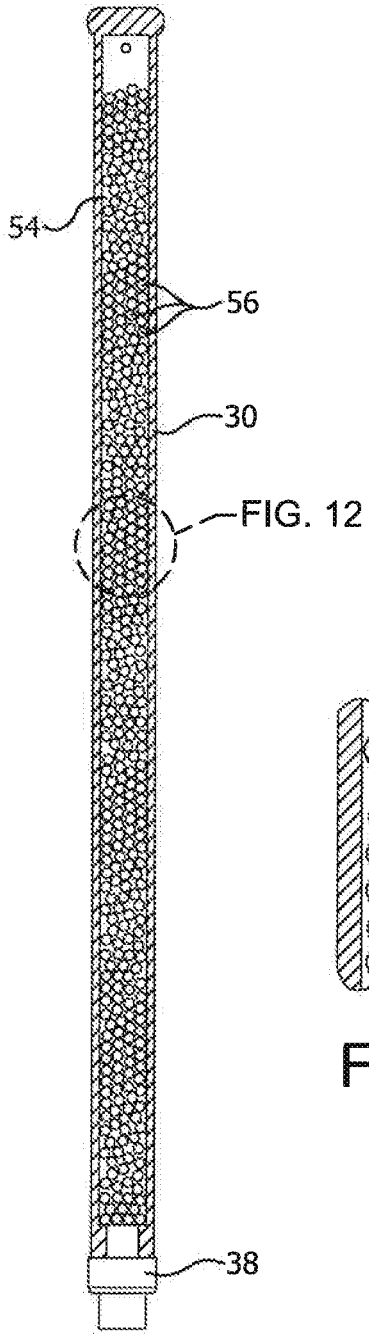
FIG. 11 is a cross-sectional view of an alternate embodiment of the slide hammer of the slide hammer tamper.
Figure 12:
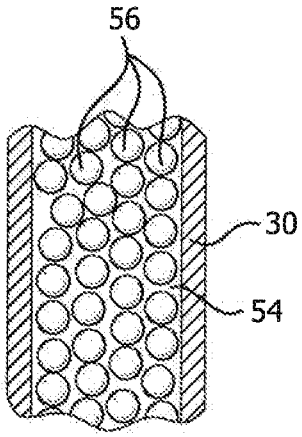
FIG. 12 is a close-up view, taken from FIG. 11.
Figure 13:
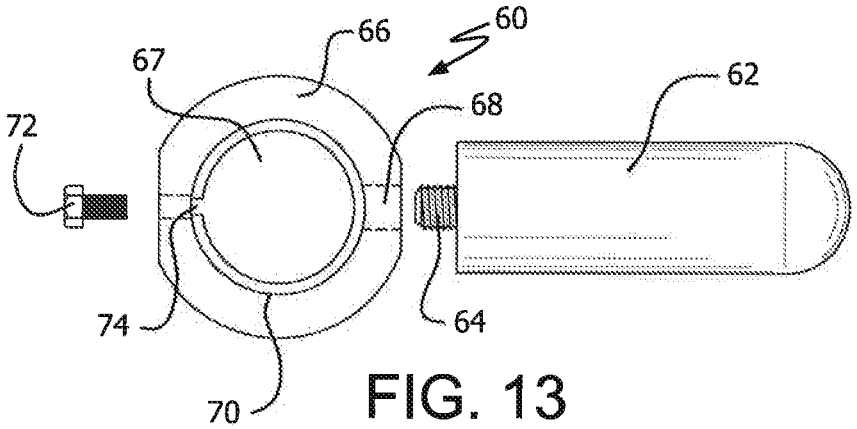
FIG. 13 is an exploded view of the parts of the handle component of the slide hammer tamper.
Figure 14:
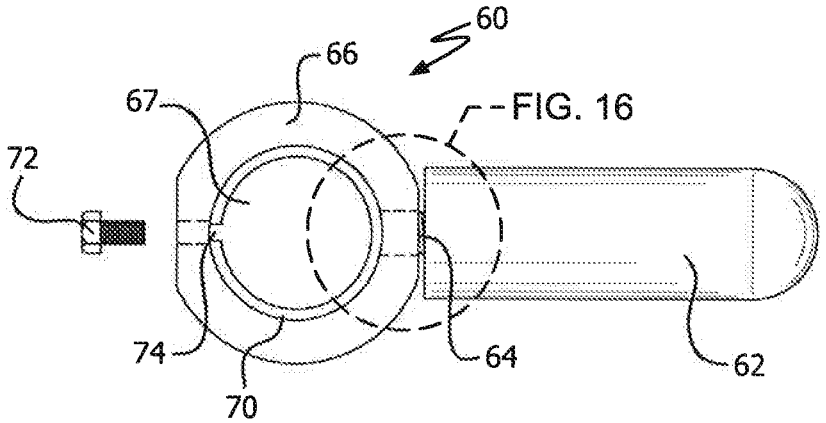
FIG. 14 is another view of the handle component of the slide hammer tamper with its gripping element attached.
Figure 15:
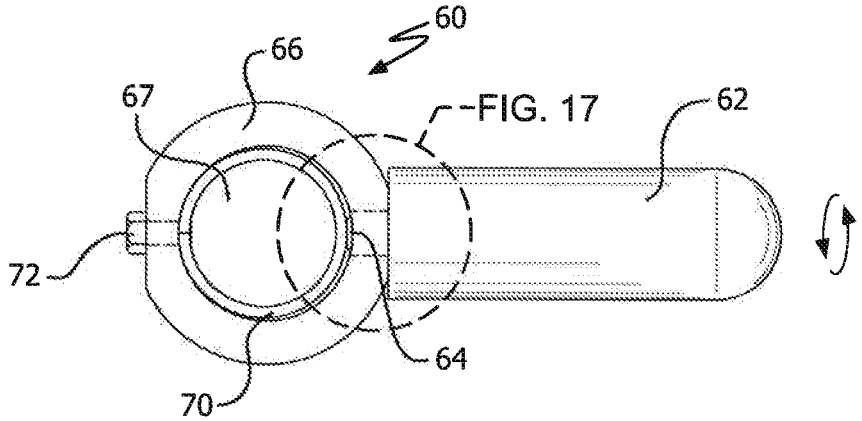
FIG. 15 is a view of the handle component of the slide hammer tamper showing the gripping element compressing the handle bushing of the handle component.
Figure 16:
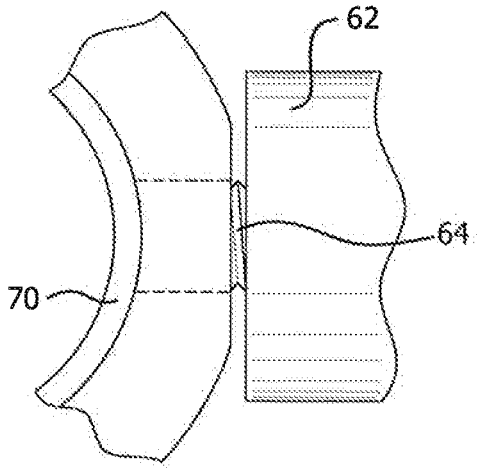
FIG. 16 is a close-up view taken from FIG. 14.
Figure 17:
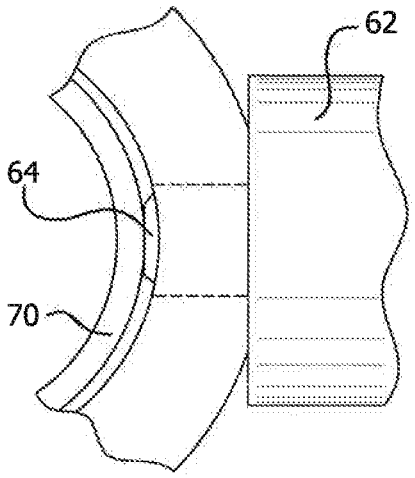
FIG. 17 is a close-up view taken from FIG. 15.

Slide hammer 30 is a heavy, solid metal member extending substantially the full length of slide hammer 30. See FIG. 10. Alternatively, slide hammer 30 can comprise hollow cavity 54, also extending substantially the full length of the cavity, but filled with a plurality of metal shot 56, to provide the necessary weight for tamping. See FIGS. 11 and 12. The use of metal shot minimizes the bounce during the downward stroke of the slide hammer.

Figure 2:
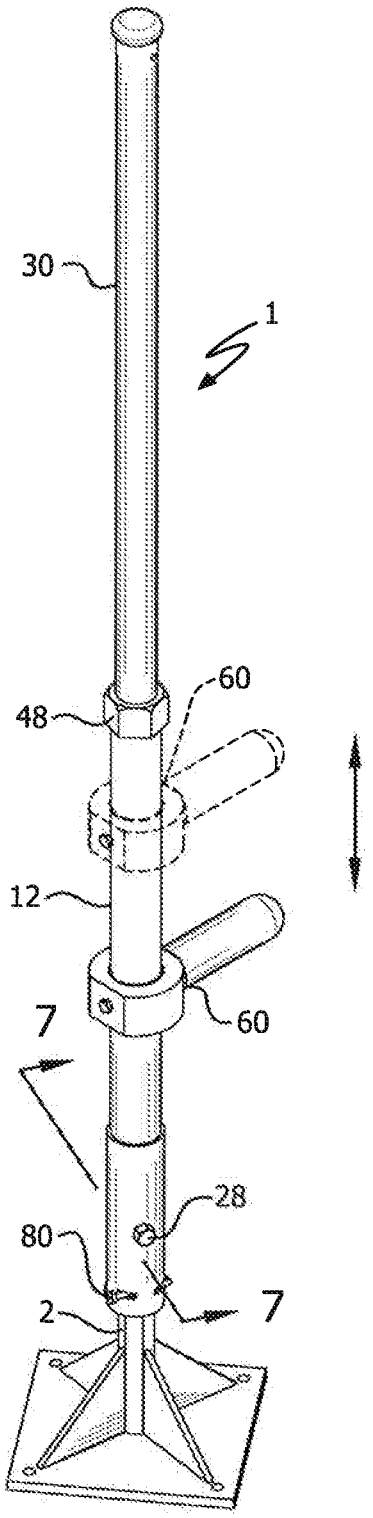
FIG. 2 shows the slide hammer tamper with the slide hammer in its highest extended position.
Figure 3:
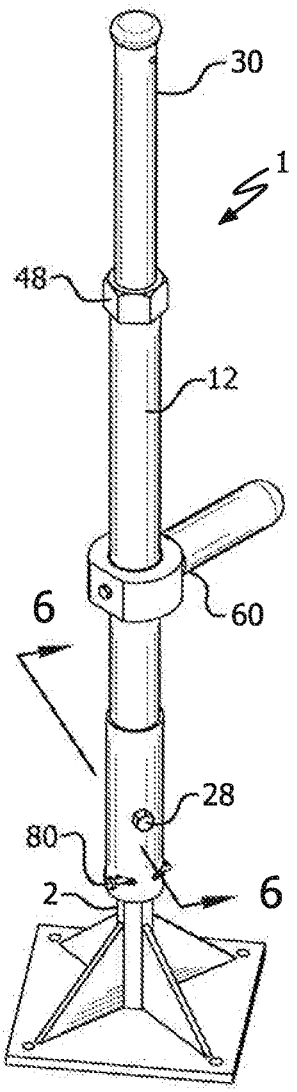
FIG. 3 shows the slide hammer tamper with the slide hammer in its lowest position.
Figure 4:
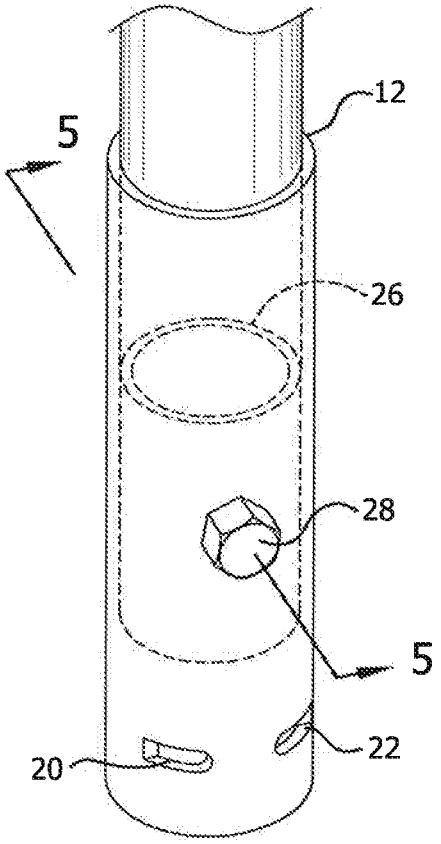
FIG. 4 is a view of the lower end of the tamper sleeve of the slide hammer tamper.
Figure 5:
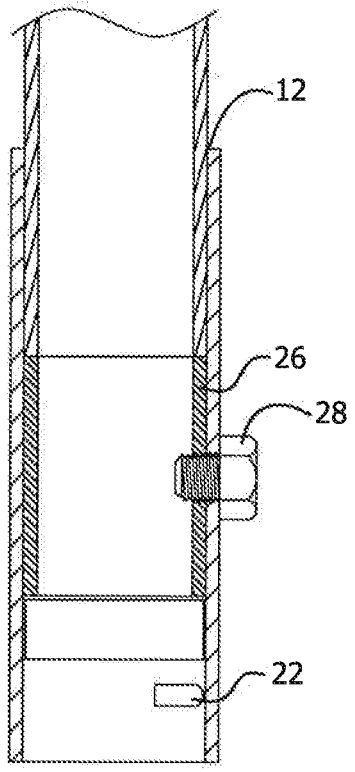
FIG. 5 is a cross-sectional view taken from FIG. 4.
Figure 6:
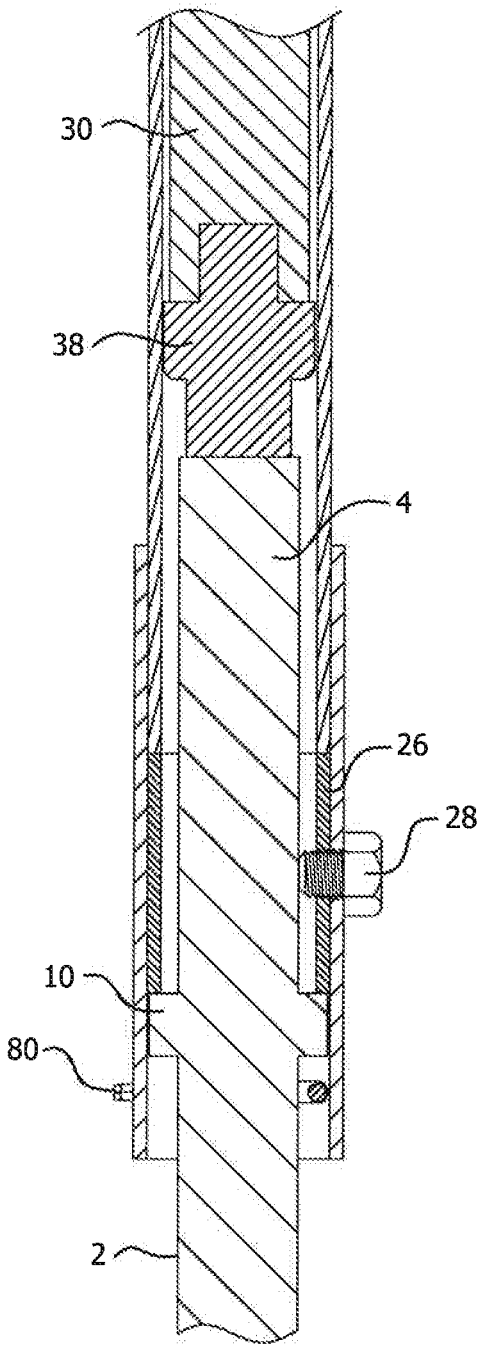
FIG. 6 is a cross-sectional view taken from FIG. 3.
Figure 7:
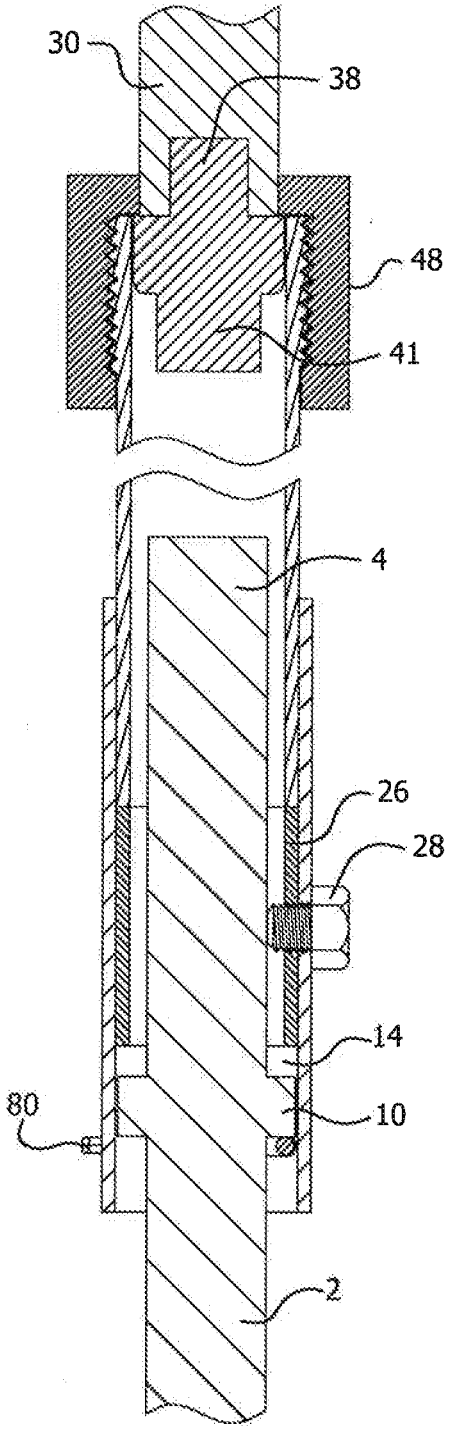
FIG. 7 is a cross-sectional view taken from FIG. 2.
Figure 8:
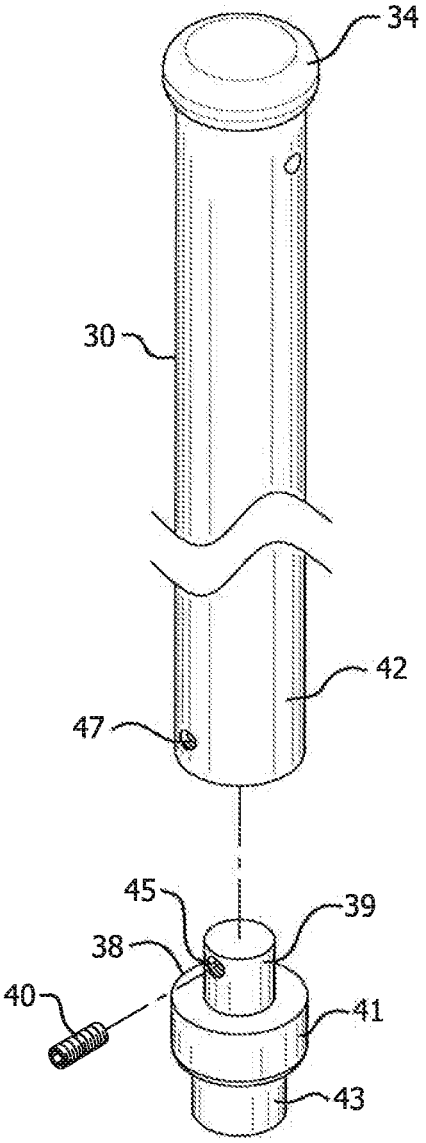
FIG. 8 is an exploded view of the slide hammer and tamper tip of the slide hammer tamper.
Figure 9:
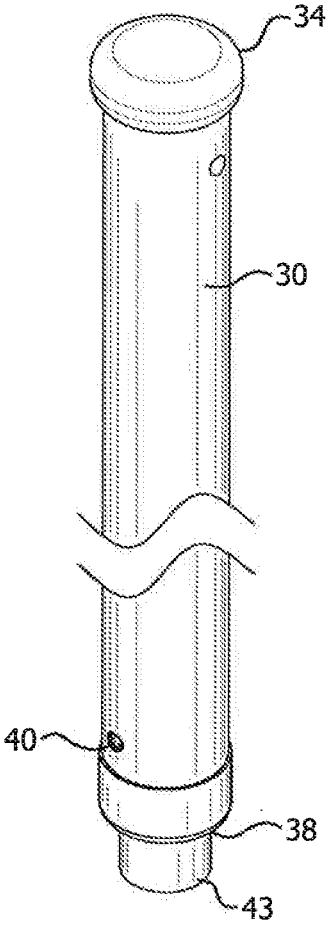
FIG. 9 is a perspective view of the tamper tip connected to the slide hammer of the slide hammer tamper.

Slide hammer 30 has an outside diameter less than the outside diameter of tamper sleeve 12 so as to allow the slide hammer to be positioned within the tamper sleeve and be vertically slideable within the tamper sleeve between an upward position, shown in FIGS. 2 and 7, in which the slide hammer is extended substantially out of the tamper sleeve with only tamper tip 38 remaining in the tamper sleeve, to a downward position, shown in FIGS. 3 and 6, in which the tamper tip contacts upper shaft 4 of tamper head 2.

Handle component 60 comprises gripping element 62 having threaded shaft 64 extending from one of its ends. Handle sleeve 66 has opening 67 and threaded opening 68 into which shaft 64 threadably engages. Handle bushing 70 is located within and against the internal surface of handle sleeve 66 and is maintained therein by bolt 72. Slot 74 is located between the ends of handle bushing 70. By this configuration, when shaft 64 of gripping element 62 is threadably engaged within opening 68 of handle sleeve 66, rotation of the gripping element in the clockwise direction, which normally tightens a connection, results in the shaft contacting handle bushing 70. Continued tightening compresses handle bushing 70, thereby slightly closing opening 67 of handle sleeve 66. By the same token, when gripping element 62 is rotated in the counterclockwise direction within opening 68, which normally loosens a connection, the compression against handle bushing 70 is released, allowing opening 67 reassumes its original size.

The internal diameter of handle bushing 70 is slightly larger than the external diameter of tamper sleeve 12, when the handle bushing is not being compressed by gripping element 62. This allows handle sleeve 66 to circumscribe and move along tamper sleeve 12. When gripping element 62 is rotated so that it is tightened against handle bushing 70, the handle bushing is compressed against tamper sleeve 12, to secure it and, hence handle component 60, to the tamper sleeve. By this unique configuration, handle component 60 can be positioned and secured at any location along tamper sleeve 12. See FIG. 2.

Figure 18:
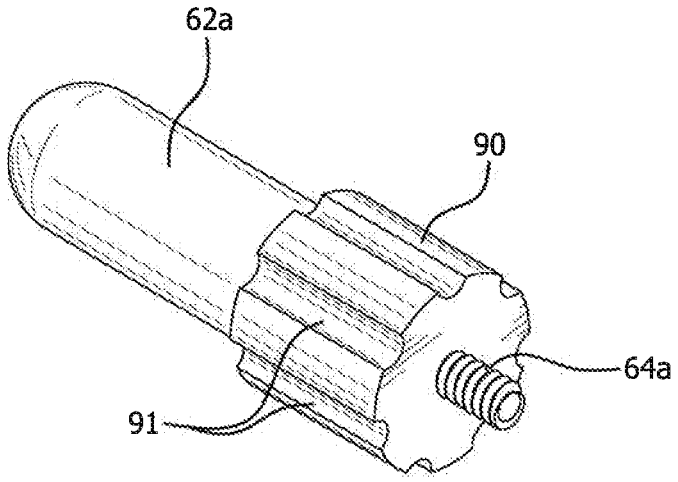
FIG. 18 is an isometric view of another embodiment of the gripping element.

Other means of tightening and assisting in the tightening of handle component 60 around tamper sleeve 12 are contemplated by using different gripping element configurations. For instance, FIG. 18 shows gripping element **62*a* with threaded shaft 64*a* and grooved leverage enhancer section 90 having a series of inset grooves 91** around the enhancer.

Figure 19:
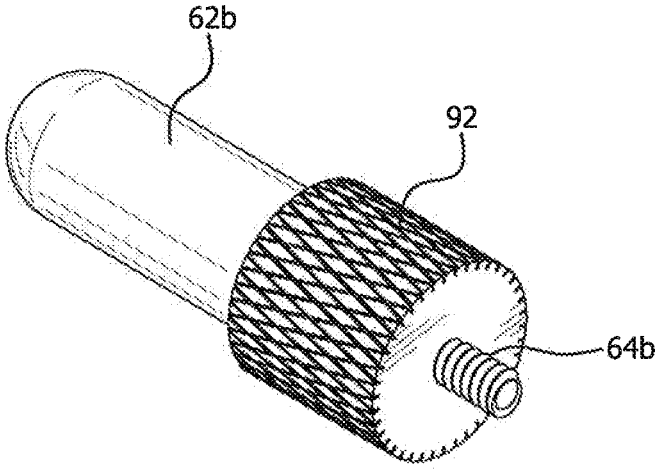
FIG. 19 is an isometric view of a third embodiment of the gripping element.

FIG. 19 shows gripping element **62*b* with threaded shaft 64*b*, having heavy knurled section 92** around the gripping element.

Figure 20:
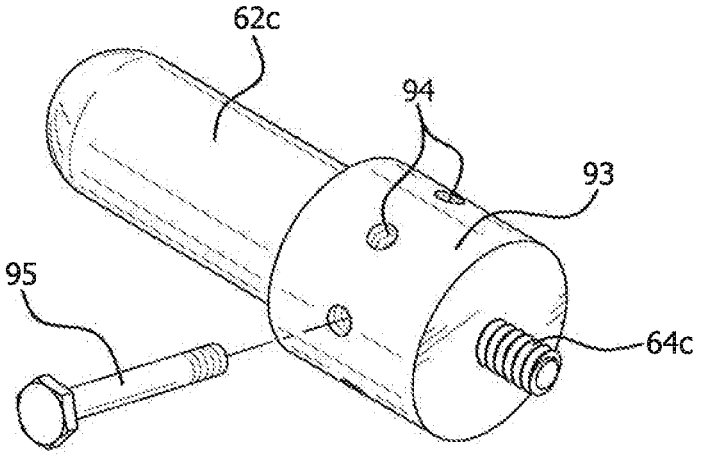
FIG. 20 is an isometric view of the components of a fourth embodiment of the gripping element.
Figure 21:
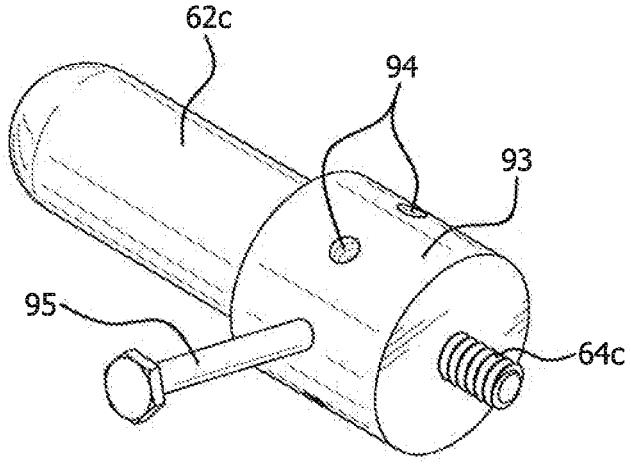
FIG. 21 is an isometric view of the embodiment shown in FIG. 20, with the components connected.
Figure 22:
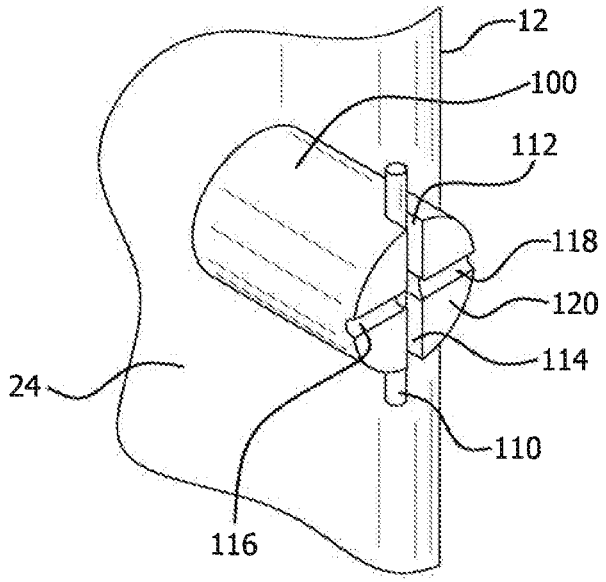
FIG. 22 is a partial view of the lower end of the tamper sleeve of the slide hammer tamper, showing an alternate means of attaching the tamper sleeve to the tamper head to prevent its removal from the tamper head.
Figure 23:
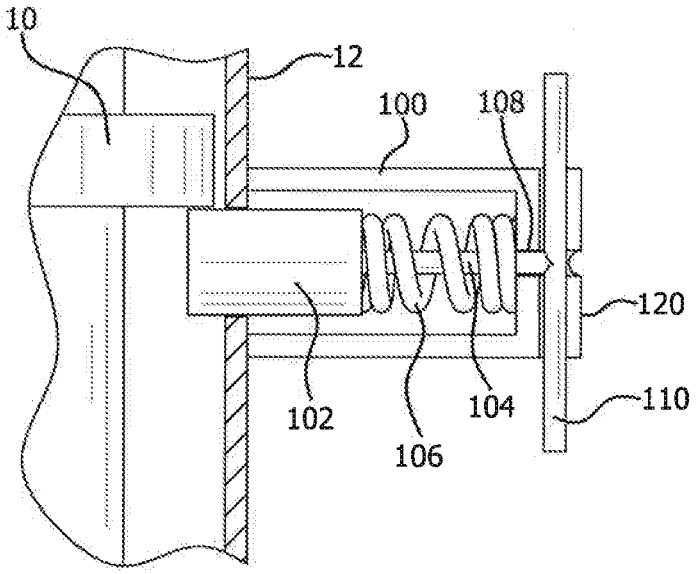
FIG. 23 is a cross-sectional view of the tamper end of the tamper sleeve of the slide hammer as shown in FIG. 22.
Figure 24:
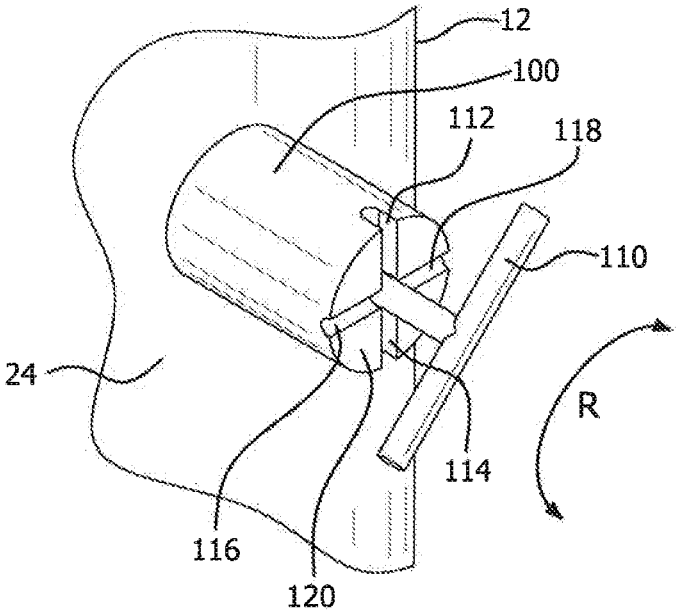
FIG. 24 is a partial view of the lower end of the tamper sleeve of the slide hammer, showing the alternate means in FIG. 22, but with its cross-pin in position to allow removal of the tamper sleeve from the tamper head.
Figure 25:
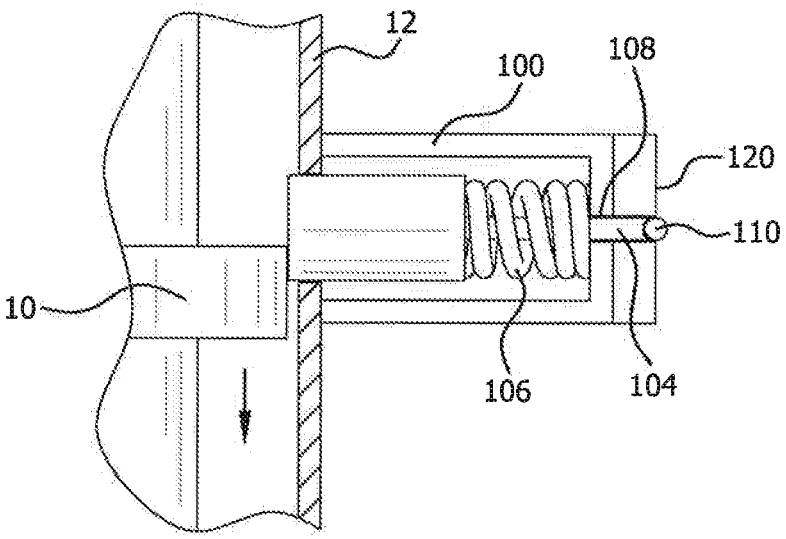
FIG. 25 is a cross-sectional view of the lower end of the tamper sleeve of the slide hammer in position to allow removal of the tamper sleeve from the tamper head.

FIGS. 20 and 21 show gripping element **62*c* with threaded shaft 64*c* and hub section 93 having a series of threaded holes 94 around the hub section. Threaded tension arm 95 is configured to be threadably engaged with holes 94 to tighten gripping element 62*c***.

Still another gripping element tightening means employs a cam lock or vice grip type locking handle which serves to actuate a pinch pin to apply pressure against handle bushing 70.

It is important to note that the means of tightening handle component 60 are not to be restricted to those embodiments disclosed herein. Equivalent tightening means can be used as well.

For use in tamping operations, the components described herein are assembled to form slide hammer tamper 1. This comprises tamper sleeve 12 being positioned over tamper sleeve support 10 of tamper head 2. When sleeve bushing 26 of tamper sleeve 12 contacts sleeve support 10 of tamper head 2, downward movement of the tamper sleeve is stopped. See FIG. 6. Pin shaft 82 of pin 80 or equivalent pin connector means is inserted through openings 20 and 22 and the pin is secured in place by pin clasp 84. Once pin 80 is in this position, tamper sleeve 12 is attached to tamper head 2 and can not be removed from the tamper head. That is, if tamper sleeve 12 is lifted up, pin shaft 82 will contact tamper sleeve support 10, preventing the tamper sleeve from being moved up any farther. See FIG. 7.

Means for attaching tamper sleeve 12 to tamper head 2 so that it can not be removed from the tamper head, other than by use of pin 80, are contemplated. Specific reference in this regard is made to FIGS. 22-25.

Housing 100 extends outward from lower end 24 of tamper sleeve 12. Located within the housing is locking pin 102, having shaft 104 around which pressure spring 106 is positioned. Locking pin shaft 104 extends through opening 108 at the end of housing 100. Cross-pin or ring 110 extends from the end of shaft 104 and is configured to either rest within deep slots 112 and 114 or shallow slots 116 and 118, depending on the position of the cross-pin, as described below. Slots 112 and 114 are positioned 180° apart so they are aligned. Slots 116 and 118 are positioned 90° from slots 112 and 114 and are also located 180° apart so that they are aligned as well. See FIGS. 22 and 24.

Deep slots 112 and 114 are inset within face 120 of housing 100. These deep slots are inset a sufficient distance such that when cross-pin 110 is located within the slots, locking pin 102 is extended into tamper sleeve 12, such that it contacts tamper sleeve support 10, thereby preventing removal of tamper head 2 from the tamper sleeve. See FIGS. 22 and 23.

To disconnect tamper sleeve 12 from tamper head 2, cross-pin 110 is lifted out of deep slots 112 and 114, against the bias of spring 106, is rotated 90° R, (see FIG. 24) and is positioned within shallow slots 116 and 118. See FIG. 25. These shallow slots are inset a sufficient distance such that when cross-pin 110 is located within the slots, locking pin 102 is withdrawn into housing 100, freeing tamper sleeve support 10 and thus allowing tamper head 2 to be easily removed from tamper sleeve 12.

As previously discussed, tamper head 2 can easily be interchanged with a different tamper head, e.g. staked head 3, by simply removing pin 80 or retracting locking pin 102 into housing 100, sliding the first tamper head out of channel 14 of tamper sleeve 12, inserting another tamper head into the channel, and replacing the pin or extending the locking pin from the housing.

Rotational movement of tamper sleeve 12 about shaft 4 of tamper head tool 2 is also restricted. Once tamper sleeve 12 is set on tamper head tool 2, any such rotational movement will be limited, since connector bolt 28, extending slightly into channel 14, will contact adjacent hexagonal corners of shaft 4, stopping the tamper sleeve rotation in either direction.

Handle sleeve 66 is located around tamper sleeve 12 so as to position handle component 60 around tamper 1. Gripping element 62 of handle component 60 is threadably loosened sufficiently to allow handle sleeve 66 to be slid up and down tamper sleeve 12. See FIG. 2.

Tamper tip 38 contacts shaft 4 of tamper tool 2, when slide hammer 30 is fully positioned within channel 14 of sleeve tamper 12. See FIGS. 3 and 6. In this position, connecting nut 48 is lowered onto threads 16 of tamper sleeve 12 and tightened around the threads. This serves to connect slide hammer 30 and tamper sleeve 12, while still allowing up and down, vertical movement of the slide hammer in relation to the tamper sleeve. Upward movement of slide hammer 30 in relation to tamper sleeve 12 is limited when slide hammer 30 is raised high enough to cause shoulder section 41 of tamper tip 38 to contact the underside of connecting nut 48.

Handle component 60 is slid to a location along tamper sleeve 12 which is convenient to allow a worker to grasp gripping element 62, in order to operate slide hammer tamper 1 efficiently. Upon reaching this location, gripping element 62 is tightened against handle bushing 70 to secure handle component 60 in place at this location.

Tamping can now commence, with the worker anchoring slide hammer tamper 1 by holding gripping element 62 with one hand, and tamping, i.e. raising and lowering slide hammer 30, with the other hand by grasping handhold 34 or other upper areas of the slide hammer. Slide hammer tamper 1 can easily be moved to another tamping location merely by lifting the device by means of handle component 60.

Once worn, tamper tip 38 can be replaced simply by detaching pin 40 from slide hammer 30 and removing the tip from the slide hammer. A fresh tip can then be inserted into lower end 42 of slide hammer 30 and again secured with pin 40.

Certain novel features and components of this invention are disclosed in detail in order to make the invention clear in at least one form thereof. However, it is to be clearly understood that the invention as disclosed is not necessarily limited to the exact form and details as disclosed, since it is apparent that various modifications and changes may be made without departing from the spirit of the invention.

The invention claimed is:

1. A slide hammer tamper comprising:

a tamper head having a tamper base, a shaft upwardly extending from the base, the shaft comprising an integral tamper sleeve support extending outwardly from and circumscribing the surface of the shaft;

a tamper sleeve positioned around the shaft of the tamper head tool, said sleeve having upper and lower ends, a through channel extending the full length of the sleeve, and a sleeve bushing attached solely by means of a connector within the channel at the lower end of the sleeve, said bushing resting on the sleeve support such that the connector provides the only means for restricting rotational movement between the shaft and the tamper sleeve; and an elongated slide hammer and a tamper tip connected to one end of the slide hammer, the slide hammer being positioned within the tamper sleeve whereby the slide hammer is vertically slideable within the tamper sleeve between an upward position in which the slide hammer is substantially out of the tamper sleeve with only the tip remaining in the tamper sleeve, to a downward position in which the tip contacts the shaft of the tamper head and the bushing contacts the tamper sleeve support.

2. The slide hammer tamper as in claim 1 wherein the tamper tip comprises a shoulder section which limits the upward position of the slide hammer.

3. The slide hammer tamper as in claim 1 wherein the tamper tip is connected to the slide hammer by a connector element which is removeable to allow the tip to be disconnected from the slide hammer and replaced by another tamper tip.

4. The slide hammer tamper as in claim 3 further comprising a handle component comprising a gripping element, a handle sleeve connected to the gripping element, a handle bushing located within the handle sleeve, and connecting means for attaching the handle bushing to the handle sleeve, the handle sleeve and handle bushing circumscribing the tamper sleeve, whereby rotation of the gripping element in a first direction in relation to the handle sleeve compresses the handle bushing to rigidly secure the handle component to the tamper sleeve and rotation of the gripping element in a second direction in relation to the handle sleeve releases the compression of the handle bushing to allow vertical movement of the handle component along the tamper sleeve.

5. The slide hammer tamper as in claim 4 further comprising first connection means located at the upper end of the tamper sleeve for connecting the tamper sleeve to the slide hammer and second connection means circumscribing the slide hammer for connecting the second connecting means to the first connecting means, whereby upon connection of the first and second connecting means, the slide hammer remains connected to the tamper sleeve and further remains slideable within the tamper sleeve.

6. The slide hammer tamper as in claim 2 wherein the tamper tip is connected to slide hammer by a connector element which is removeable to allow the tip to be disconnected from the slide hammer and replaced by another tamper tip.

7. A slide hammer tamper comprising:

a tamper head having an upwardly extending shaft;

a tamper sleeve positioned around the shaft of the tamper tool, said sleeve having upper and lower ends and a through channel extending the full length of the sleeve;

an elongated slide hammer and a tamper tip removeably connected to one end of the slide hammer, the slide hammer being positioned within the tamper sleeve whereby the slide hammer is vertically slideable within the tamper sleeve, the slide hammer comprising a cavity extending substantially the full length of the slide hammer and a plurality of metal shot substantially filling the cavity, and wherein the tamper tip is connected to the slide hammer by a connector element which is removeable to allow the tip to be disconnected and removed from the slide hammer and replaced by another tamper tip; and first connection means located at the upper end of the tamper sleeve for connecting the tamper sleeve to the slide hammer, and second connecting means circumscribing the slide hammer for connecting the second connecting means to the first connecting means, whereby upon connection of the first and second connecting means, the slide hammer remains connected to the tamper sleeve and remains slideable within the tamper sleeve.

8. The slide hammer tamper as in claim 7 further comprising a handle component comprising a gripping element, a handle sleeve connected to the gripping element, a handle bushing located within the handle sleeve and connecting means for attaching the handle bushing to the handle sleeve, the handle sleeve and handle bushing circumscribing the tamper sleeve, whereby rotation of the gripping element in a first direction in relation to the handle sleeve compresses the handle bushing to rigidly secure the handle component to the tamper sleeve and rotation of the gripping element in a second direction in relation to the handle sleeve releases the compression of the handle bushing to allow vertical movement of the handle component along the tamper sleeve.

9. A slide hammer tamper comprising:

a tamper head having an upwardly extending shaft;

a tamper sleeve positioned around the shaft of the tamper head tool, said sleeve having upper and lower ends and a through channel extending the length of the sleeve;

an elongated slide hammer and a tamper tip connected to one end of the slide hammer, the slide hammer being positioned within the tamper sleeve whereby the slide hammer is vertically slideable within the tamper sleeve; and a handle component circumscribing the tamper sleeve comprising a gripping element, a handle sleeve connected to the gripping element, a handle bushing located within and against the internal surface of the handle sleeve, and connecting means for attaching the handle bushing to the handle sleeve, the handle sleeve and handle bushing circumscribing the tamper sleeve, whereby rotation of the gripping element in a first direction in relation to the handle sleeve compresses the handle bushing to rigidly secure the handle component to the tamper sleeve and rotation of the gripping element in a second direction in relation to the handle sleeve releases the compression of the handle bushing to allow vertical movement of the handle component and along the tamper sleeve.

10. The slide hammer tamper as in claim 9 wherein the tamper tip is connected to the slide hammer by a connector element which is removeable to allow the tip to be disconnected and removed from the slide hammer and replaced by another tamper tip.

11. The slide hammer tamper as in claim 10 wherein the slide hammer comprises a cavity extending substantially the full length of the slide hammer and a plurality of metal shot substantially filling the cavity.

12. A slide hammer tamper comprising:

a tamper head having a tamper base, a shaft upwardly extending from the base, the shaft comprising an integral tamper sleeve support extending outwardly from and circumscribing the outside surface of the shaft;

a tamper sleeve positioned around the shaft of the tamper head tool, said sleeve having an upper end and a lower end having at least one opening extending completely through the sleeve, and a through channel extending the full length of the sleeve;

removeable pin means extending through said at least one opening for attaching the tamper head to the tamper sleeve and for restricting the upward movement of the tamper sleeve in relation to the tamper head when the tamper sleeve support contacts the pin means, whereby removal of the pin means from the at least one opening allows detachment of the tamper head from the tamper sleeve; and an elongated slide hammer comprising and a tamper tip connected to one end of the slide hammer, the slide hammer being positioned within the tamper sleeve whereby the slide hammer is vertically slideable within the tamper sleeve between an upward position in which the slide hammer is substantially out of the tamper sleeve with only the tip remaining in the tamper sleeve, to a downward position in which the tip contacts the shaft of the tamper head.

13. The slide hammer tamper as in claim 12 whereby said upward movement of the tamper sleeve is restricted upon contact between the pin means and the tamper sleeve support.

14. The slide hammer tamper as in claim 12 wherein the tamper tip is connected to the slide hammer by a connector element which is removeable to allow the tip to be disconnected and removed from the slide hammer and replaced by another tamper tip.

15. The slide hammer tamper as in claim 12 further comprising a handle component comprising a gripping element, a handle sleeve connected to the gripping element, a handle bushing located within the handle sleeve, and connecting means for attaching the handle bushing to the handle sleeve, the handle sleeve and handle bushing circumscribing the tamper sleeve, whereby rotation of the gripping element in a first direction in relation to the handle sleeve compresses the handle bushing to rigidly secure the handle component to the tamper sleeve, and rotation of the gripping element in a second direction in relation to the handle sleeve releases the compression of the handle bushing to allow vertical movement of the handle component along the tamper sleeve.

16. The slide hammer tamper as in claim 12 further comprising first connection means located on the tamper sleeve for connecting the tamper sleeve to the slide hammer and second connecting means circumscribing the slide hammer for connecting the second connecting means to the first connecting means, whereby upon connection of the first and second connecting means, the slide hammer remains connected to the tamper sleeve and remains slideable within the tamper sleeve.

17. The slide hammer tamper as in claim 16 further comprising a handle component comprising a gripping element, a handle sleeve connected to the gripping element, a handle bushing located within the handle sleeve, and connecting means for attaching the handle bushing to the handle sleeve, the handle sleeve and handle bushing circumscribing the tamper sleeve, whereby rotation of the gripping element in a first direction in relation to the handle sleeve compresses the handle bushing to rigidly secure the handle component to the tamper sleeve, and rotation of the gripping element in a second direction in relation to the handle sleeve releases the compression of the handle bushing to allow vertical movement of the handle component along the tamper sleeve.

* * * * *